US010151038B2

(12) United States Patent
Rochet et al.

(10) Patent No.: US 10,151,038 B2
(45) Date of Patent: Dec. 11, 2018

(54) ELECTROLYTIC DEVICE AND ANODE ASSEMBLY INTENDED FOR THE PRODUCTION OF ALUMINIUM, ELECTROLYTIC CELL AND APPARATUS COMPRISING SUCH A DEVICE

(71) Applicant: Rio Tinto Alcan International Limited, Montreal (CA)

(72) Inventors: Yves Rochet, Saint Jean de Maurienne (FR); Frédéric Brun, Saint Jean de Maurienne (FR); Steeve Renaudier, Saint Michel de Maurienne (FR)

(73) Assignee: Rio Tinto Alcan International Limited, Montreal (CA)

( * ) Notice: Subject to any disclaimer, the term of this patent is extended or adjusted under 35 U.S.C. 154(b) by 195 days.

(21) Appl. No.: 14/911,144

(22) PCT Filed: Jul. 30, 2014

(86) PCT No.: PCT/CA2014/050720
§ 371 (c)(1),
(2) Date: Feb. 9, 2016

(87) PCT Pub. No.: WO2015/017922
PCT Pub. Date: Feb. 12, 2015

(65) Prior Publication Data

US 2016/0186343 A1 Jun. 30, 2016

(30) Foreign Application Priority Data

Aug. 9, 2013 (FR) ..... 13 01910
Jan. 27, 2014 (FR) ..... 14 00175

(51) Int. Cl.
*C25C 3/12* (2006.01)
*C25C 3/16* (2006.01)
*C25C 3/10* (2006.01)

(52) U.S. Cl.
CPC ..... *C25C 3/12* (2013.01); *C25C 3/10* (2013.01); *C25C 3/16* (2013.01)

(58) Field of Classification Search
CPC ..... C23C 3/10; C23C 3/12; C23C 3/16
See application file for complete search history.

(56) References Cited

U.S. PATENT DOCUMENTS 3,575,827 A 4/1971 Johnson
3,607,685 A 9/1971 Johnson
(Continued)

FOREIGN PATENT DOCUMENTS

FR 2694945 A1 2/1994

OTHER PUBLICATIONS

Oct. 8, 2014—International Search Report of PCT/CA2014/050720.

*Primary Examiner* — Louis J Rufo
(74) *Attorney, Agent, or Firm* — Banner & Witcoff, Ltd.

(57) ABSTRACT

An electrolysis device comprising a pot shell (3) and an inner lining (5) defining an opening (16) through which an anode block (15) suspended from an anode support (13, 17) forming an anode assembly (12) moves vertically by means of an anode receiver (25), said anode receiver being placed outside a space defined by the top of said anode block (15), said anode receiver comprising an anode contact surface (27) working in conjunction with the anode support (13, 17) to establish therewith electrical contact and mechanical contact to moving the anode assembly (12) vertically.

An anode assembly (12).

An electrolytic cell and an electrolysis installation comprising such an anode assembly.

21 Claims, 9 Drawing Sheets

(56) References Cited

U.S. PATENT DOCUMENTS

| | | | | |
|---|---|---|---|---|
| 5,378,338 | A | 1/1995 | Langon et al. | |
| 5,876,585 | A * | 3/1999 | Schenk | C25C 3/16 204/245 |
| 2007/0295601 | A1 * | 12/2007 | Bayer | C25C 3/16 204/225 |

* cited by examiner

ELECTROLYTIC DEVICE AND ANODE ASSEMBLY INTENDED FOR THE PRODUCTION OF ALUMINIUM, ELECTROLYTIC CELL AND APPARATUS COMPRISING SUCH A DEVICE

CROSS-REFERENCE TO RELATED APPLICATIONS

The present application is a U.S. National Phase filing of International Application No. PCT/CA2014/050720, filed on Jul. 30, 2014, designating the United States of America and claiming priority to French Patent Application No. 13/01910 filed Aug. 9, 2013, and French Patent Application No. 14/00175 filed Jan. 27, 2014, and the present application claims priority to and the benefit of all the above-identified applications, which are incorporated by reference herein in their entireties.

SCOPE OF THE INVENTION

The invention relates to the production of aluminum using igneous electrolysis. The invention more particularly relates to an electrolysis device associated with an electrolytic pot using at least one anode assembly moved vertically during electrolysis, and electrically powered by anode conductors.

STATE OF THE ART

Metallic aluminum is produced industrially by igneous electrolysis, namely by electrolysis of alumina in solution in a molten cryolite bath, known as an electrolyte bath, using the well-known Hall-Héroult process. The electrolyte bath is contained in pots, called "electrolytic pots", each pot comprising a steel pot shell with a liner usually made from refractory and/or insulating materials. An electrolytic pot comprises cathode assemblies located at the bottom of the pot, each cathode assembly comprising a cathode made of carbonaceous material. Anodes are partially immersed in the electrolyte bath. The anodes are more particularly of the pre-baked anode type with pre-baked carbon anode blocks, i.e. baked before being inserted into the electrolytic pot. The anode blocks are often suspended from an anode support to form with said block what is often called the anode assembly. The anode assembly is generally movable relative to the pot shell and can move vertically by means of moving means in order to compensate for the consumption of anode blocks during electrolysis and level variations of aluminum accumulating on the cathode.

The electrolytic pot may receive several anode assemblies generally distributed along a longitudinal direction of the pot and of its shell, the anode support of said anode assemblies extending along a transverse direction of the pot and its shell. The assembly formed by an electrolytic pot, its anode and the electrolyte bath is often referred to as an electrolytic cell. An electrolysis installation may comprise a series of several pots extending along the transverse direction of the pot and its shell.

The anode assemblies and cathode assemblies of an electrolytic pot are electrically connected by a network of electrical conductors. Cathode conductors are connected to the cathode assemblies to collect an electrolysis current at the cathode and to lead it to the cathode outputs through the bottom or sides of the pot shell. The cathode outputs are in turn electrically connected through routing conductors, to the anode conductors electrically feeding the anode assemblies of the next pot. These routing conductors extend generally in a substantially horizontal direction. The anode conductors are electrically connected to the anode assemblies of the next pot. The electrolysis current is in this way routed from the cathode of one electrolytic pot to the anode blocks of the next electrolytic pot, via cathode conductors, routing of conductors, anode conductors and the anode support of the anode assemblies.

The anode assemblies can be moved vertically via moving means in order to compensate for the consumption of the anode blocks. The anode assemblies can also be moved vertically during anode replacement maneuvers by other means, such as handling tools. During such vertical movement of the anode assemblies, the anode blocks are moved through an opening defined by the lining inside the pot shell of the electrolytic pot. The vertical movements of the anode assemblies during anode replacement maneuvers may be limited by the presence of electrolytic cell equipment arranged above this opening.

For example, the French patent published as number 2694945 describes a pot superstructure comprising a rigid beam arranged above the electrolytic pot and extending in the longitudinal direction of the shell of said pot, the beam supporting an anode frame to which are connected both risers for electrical current and anode rods. The rigid beam of the superstructure also supports mechanisms for raising and lowering anodes to move the anode frame and the anodes fixed to said anode frame vertically. Such an arrangement of the superstructure, the anode frame and current risers above the electrolytic pot tends to reduce the space available above the shell of said pot, and to limit the vertical movement of the anodes for anode replacement maneuvers.

U.S. Pat. No. 3,575,827 discloses an electrolytic cell with an anode assembly comprising a metal plate surmounted by a bridge integral with said plate and an anode block suspended from said plate, said anode assembly being adjusted up or down using jacks fixed on the outer face of the walls of a pot shell of said cell on which the anode assembly rests.

In the electrolytic cell described in the U.S. patent cited above, a flexible conductor is used to route the electrolysis current to a conductor integral with the anode assembly, this latter conductor being attached to the top of the metal plate to which the anode block is suspended. It follows that, during anode replacement maneuvers, dismantling the anode assembly appears to initially require the flexible conductor of the anode assembly to be disconnected, and then the anode assembly to be separated from the jacks. Similarly, mounting the anode assembly appears to take place in two steps, first by fixing the anode assembly to the jacks and then connecting the flexible conductor to the anode assembly. In addition, during anode replacement maneuvers, disconnecting the flexible conductor may leave the end of this conductor in the way of the anode block or the anode assembly, which can lead to mechanical interactions with said conductor leading to wear or damage. Furthermore, in the absence of an anode assembly in the electrolytic cell, during maintenance operations, the disconnected end of the flexible conductor may come in contact with the electrolyte inside the electrolytic pot, which could lead to damage of said conductors or to other problems with the operation of said pot.

DESCRIPTION OF THE INVENTION

The present invention relates to an electrolysis device associated with an electrolytic pot to facilitate anode replacement maneuvers and promote accessibility for handling tools and work in the electrolytic pot. The invention also aims to allow anode replacement maneuvers to be performed without stopping the production of aluminum in the pot. The invention also aims to limit wear of, and damage to the anode conductors during anode replacement maneuvers.

The invention relates to an electrolysis device for the production of aluminum comprising a pot shell having an inner lining defining an opening through which at least one anode block is designed to be moved, said at least one anode block being suspended from an anode support forming with said at least one anode block an anode assembly, mobile with regard to the pot shell, said device further comprising moving means comprising at least one anode receiver designed to work in conjunction with said anode support to move the anode assembly in a substantially vertical direction, said anode support being designed to be connected to anode conductors so as to route an electrolysis current to said at least one anode block, said electrolysis device being characterized in that said at least one anode receiver is placed outside a space defined by the top of said at least one anode block during its movement through the opening, said at least one anode receiver comprising a contact surface working in conjunction with a corresponding anode contact surface of the anode support to establish with said anode support an electrical contact to route the electrolysis current between said at least one anode receiver and the anode assembly, and a mechanical contact to move said anode assembly in a substantially vertical direction.

According to the invention, said at least one anode receiver is placed outside a space defined by the top of the at least one anode block during its movement through the opening. In other words, said at least one anode receiver is not arranged in line with the at least one anode block during its movement through the opening, or said at least one anode receiver is placed outside a vertical projection of the translation path of the at least one anode block during its movement through the opening.

The invention aims to facilitate anode replacement maneuvers and promote accessibility for handling tools and work in the electrolytic pot. The invention also makes it possible to limit wear of, and damage to the anode conductors during anode replacement maneuvers. The invention also makes it possible to perform anode replacement maneuvers without stopping the production of aluminum in the electrolytic pot.

Preferably, the electrolysis device of the invention is designed to receive a plurality of anode assemblies distributed along a longitudinal direction of the pot shell, the anode support of said anode assemblies extending along a transverse direction of said pot shell, said device further comprising compensating means working in conjunction with the moving means to absorb the expansion of said anode support along the transverse and/or longitudinal direction.

This is because during mounting of the anode assembly in the pot shell, the anode support of said assembly heats up, which causes an expansion of said support which is particularly significant in the transverse direction. This expansion causes mechanical stresses to be generated on the anode receiver of the moving means, which may lead to these movement means becoming blocked or damaged. These mechanical stresses may deform not only the receiver but also the anode assembly, causing unevenness and therefore poor electrical contact. In general, the compensation means make it possible to tolerate any unevenness to ensure good electrical contact by permitting a certain deformation range, thereby releasing the mechanical stresses associated with thermal expansion or possible torsion of the anode support when it is being handled.

"Compensating means working in conjunction with the moving means" means that between the compensating means and the moving means there is at least one functional cooperation, but not necessarily a physical cooperation, i.e. the compensating means act directly or indirectly on the moving means. In other words, the compensating means may interact directly with, or be incorporated in, the moving means particularly the anode receiver of said moving means. Alternatively, the compensating means may have no direct interaction with the moving means, for example by being incorporated in the anode support of the anode assembly.

Preferably, the contact surface of the at least one anode receiver is arranged over said at least one anode receiver to bear the anode assembly. In this way, electrical contact between the anode receiver and the anode support is improved.

Preferably, the at least one anode receiver comprises a drive part guided translationally along the substantially vertical direction and an electrically conductive part. In this way, it is possible to optimize the anode receiver by disconnecting the move function, and optionally the support function, from the electrical conduction function, at least over a large section of the anode receiver. The drive section may be made of steel. The drive section works in conjunction with the drive means and the guide means. The conductive portion may be made of copper. This configuration makes it possible to limit electrical resistance.

Preferably, the contact surface of at the least one anode receiver is arranged on the conductive portion of said anode receiver. In this way, disconnection of the move function and the electrical conduction function is achieved over the majority of the anode receiver, but not over all of said anode receiver. It is only at the contact surface of the anode receiver that the conductive section alone makes it possible to perform the double function of movement and conduction of electricity.

According to one embodiment of the present invention, the contact surface is substantially horizontal, the compensating means being essentially formed by said contact surface and the anode contact surface of the anode support working in conjunction with said contact surface, the expansion of the anode support in the transverse direction being absorbed by sliding of said anode contact surface on said contact surface in the transverse and/or longitudinal direction of said support surface.

To ensure good electrical contact between the anode receiver and the anode assembly, the contact surface of the at least one anode receiver and the corresponding anode contact surface of the anode support generally have complementary shapes.

Preferably, the contact surface of the at least one anode receiver and the corresponding anode contact surface of the anode support are flat and horizontal.

Alternatively, the contact surface of the at least one anode receiver and the corresponding anode contact surface of the anode support can have various shapes, in particular to maximize the extent of these surfaces and in so doing enhance the electrical conductivity between the anode receiver and the anode support.

According to one embodiment, the contact surface of the at least one anode receiver may comprise a neck or groove passing through all of said contact surface and whose major axis extends parallel to the transverse direction of the pot shell. This embodiment makes it possible to enhance sliding of the anode contact surface of the anode support on the corresponding contact surface of the anode receiver in the transverse direction of the pot shell. In this case, the corresponding anode contact surface has an oblong projecting part designed to work in conjunction with the neck. Preferably, the neck and the corresponding oblong protrusion have a transverse profile shaped like the arc of a circle, for example a semicircle.

In the preferred case of an anode support comprising at least two anode contact surfaces designed to be supported on two corresponding surfaces of anode receivers arranged on each longitudinal edge of the pot shell, the main directions of the neck and the corresponding oblong protrusion may be oriented in the transverse direction of the pot shell for contact surfaces on one longitudinal edge of the pot shell and oriented in the longitudinal direction for surfaces on the other longitudinal edge of the pot shell.

Preferably, sliding of the anode contact surface of the anode support on the contact surface is facilitated by the use of an electrically conductive grease applied on one of said surfaces.

According to another embodiment of the present invention, the compensating means are arranged in said at least one anode receiver. The anode support may advantageously be attached to the anode receiver so that the anode contact surface of the anode support is compressed against the contact surface of the anode receiver, without risking any deterioration of the moving means.

Preferably, the compensating means are arranged between an upper part of at least one anode receiver bearing the contact surface and the drive part.

According to one variant, the compensating means comprise at least one connecting member between the upper part and the drive part making it possible to absorb the expansion of said anode support along the transverse direction or the longitudinal direction, such as a connecting member of the connecting rod type.

Preferably, the moving means are equipped with at least two anode receivers per anode assembly arranged on either side of the pot shell with respect to the transverse direction, a first connecting member of one of the anode receivers allowing any expansion of said anode support along the transverse direction to be absorbed, and a second connecting member of the other anode receiver to absorb any expansion of said anode support along the longitudinal direction.

According to another variant, the compensating means comprise at least one connecting member between the upper part and the drive part making it possible to absorb the expansion of said anode support along the transverse direction and the longitudinal direction, such as a connecting member of the ball type.

According to one embodiment of the present invention, the drive portion of the anode receiver comprises a lifting mast driven translationally and a sole connected to said lifting mast via the connecting member, the conductive portion comprising at least one side conductor and one conductive plate placed on said sole electrically connected to said side conductor.

According to another embodiment of the present invention, the drive portion includes strapping surrounding the electrically conductive portion with sufficient clearance to allow said conductive portion to deform within said strapping and absorb expansion of the anode support along the transverse and/or longitudinal direction.

Preferably, the moving means are equipped with at least two anode receivers per anode assembly, said anode receivers being arranged along each longitudinal wall of the pot shell respectively, on the outside of said pot shell.

Preferably, the at least two anode receivers per anode assembly are associated with separate drive means.

Preferably, the electrolysis device includes guide means arranged along the longitudinal walls of the pot shell, on the outside of said pot shell, said guide means being arranged in a welded structure forming said pot shell.

Preferably, the opening defined by the interior lining of the pot shell and the anode assembly is covered by a removable cover.

According to another embodiment of the invention, the compensating means are arranged in the anode support.

The invention also relates to an anode assembly designed to be installed in an electrolysis device for the production of aluminum, said anode assembly comprising an anode support and at least one anode block suspended from said anode support, said anode support being designed to be connected to anode conductors to route an electrolysis current to said at least one anode block, said at least one anode block being designed to be moved in a substantially vertical direction through an opening defined by a pot shell and its inner lining of said electrolysis device using at least one anode receiver of means for moving said electrolysis device working in conjunction with said anode support, said anode assembly being characterized in that the anode support comprises at least one anode contact surface working in conjunction with a corresponding contact surface of said at least one anode receiver to establish with said at least one anode receiver an electrical contact for routing the electrolysis current between said at least one anode receiver and the anode assembly, and a mechanical contact to move said anode assembly in a substantially vertical direction, the at least one anode contact surface of the anode support being arranged outside a space defined by the top of said at least one anode block.

According to the invention, the at least one anode contact surface of the anode support is arranged outside a space defined by the top of said at least one anode block. In other words, at least one anode contact surface is not placed in line with at least one anode block.

As described more fully above, such a configuration makes it possible to receive anode assemblies on anode receivers of the electrolysis device which are arranged outside the vertical translation path of the anode blocks.

Preferably the anode support of the anode assembly extends along a main direction corresponding to a transverse direction of the pot shell when the anode assembly is received in the electrolysis device, and said anode support includes compensating means for absorbing the expansion of said anode support along said main direction and/or a secondary direction of said anode support corresponding to a longitudinal direction of said pot shell when the anode assembly is installed in said electrolysis device.

In general, the compensating means can correct unevenness to provide good electrical contact and to counter thermal expansion or possible torsion of the anode support.

Preferably the anode support includes a frame, bearing the at least one anode block, and an electrical conductive portion, the at least one anode contact surface of said anode support being arranged in said conductive part.

According to one embodiment, the compensating means of the anode support comprise at least one connecting member, such as a connecting member of the connecting rod type or a connecting member of the sliding type, placed between the at least one anode contact surface and a main part of the frame to absorb any expansion of said anode support along the main direction or secondary direction.

Preferably, the anode support comprises two anode contact surfaces placed on each side of said anode support relative to the main direction, a first connecting member placed between one of the anode contact surfaces and the main part of the frame to absorb any expansion of said anode support along the main direction and a second connecting member placed between the other anode contact surface and the main frame portion to absorb any expansion of said anode support along the secondary direction.

Preferably, at least one connecting member is used to absorb the expansion of the anode support along the main direction and the secondary direction, such as a connecting member of the ball type.

The invention also relates to an electrolytic cell, said cell being characterized in that it comprises an electrolysis device as described above, said electrolytic cell further comprising, an electrolytic pot formed by the pot shell and the inner lining of said electrolysis device, an electrolyte bath contained within said vessel and at least one anode assembly comprising an anode block at least partially immersed in said electrolyte bath.

The invention will be better understood from the detailed description of preferred embodiments thereof which are described below, in a non-limiting manner, and which are illustrated with the accompanying figures.

FIG. 1 shows a sectional view of two adjacent electrolytic cells according to the invention, along a cross section A-A of FIG. 2 described below.

2 shows a cross section of one of the electrolytic cells of FIG. 1, along a longitudinal section B-B.

The description below is given with respect to a Cartesian reference system, shown in FIG. 1, which is related to each electrolytic pot 1, the X axis being oriented in a transverse direction of the electrolytic pots, the Y axis being oriented in a longitudinal direction of the electrolytic pots, and the Z axis being oriented in a vertical direction of the electrolytic pots. Longitudinal, vertical and transverse orientations, directions, plans and movements are defined relative to this standard.

Figure 1:
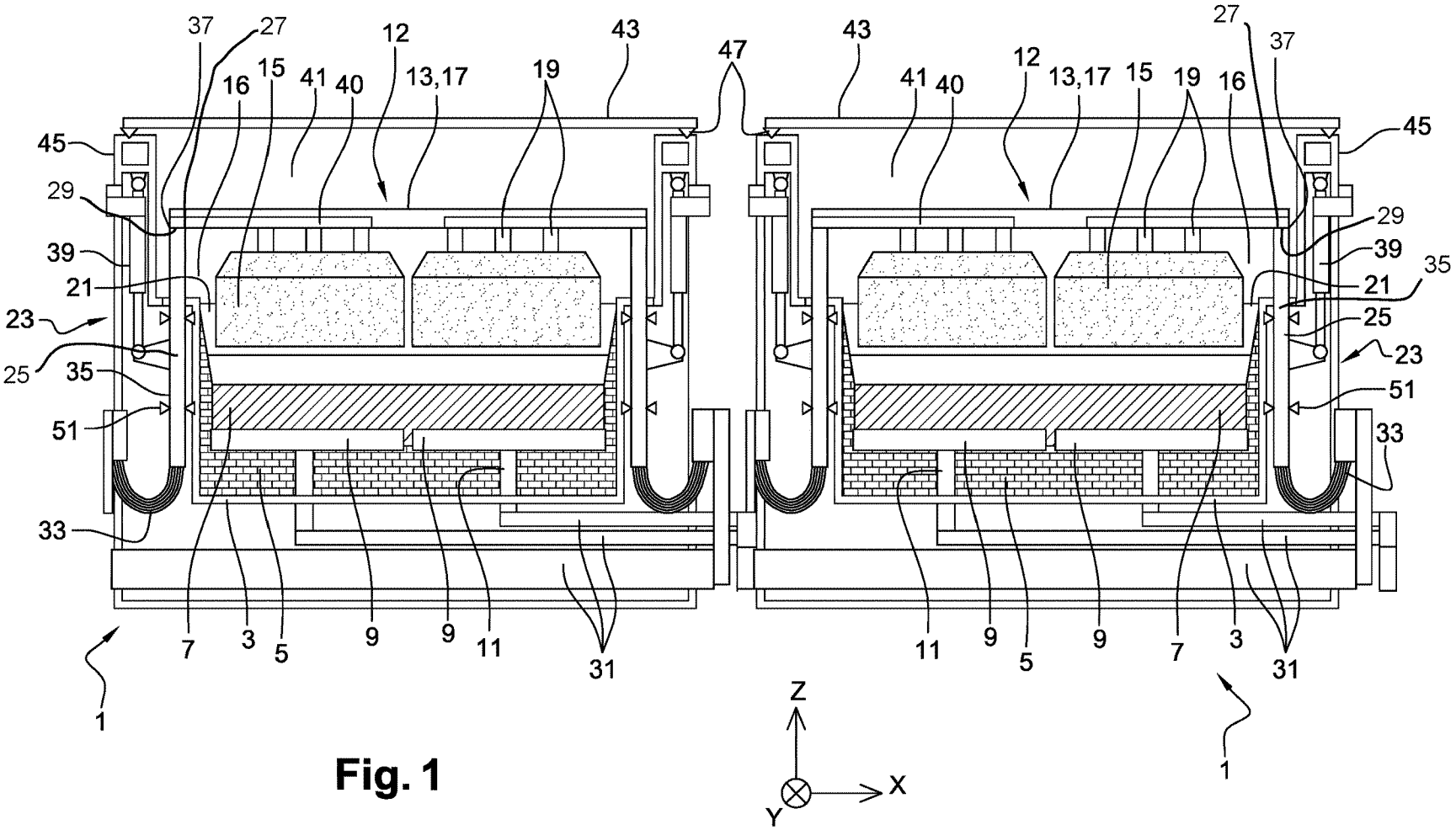
FIG. 1 shows two adjacent electrolytic pots 1 for the production of aluminum by electrolysis, said pots each being associated with an electrolysis device 1 according to a first embodiment of the invention.

Referring to FIG. 1 and to the Cartesian reference in the same figure, the electrolytic pot 1 is arranged perpendicularly to the length of a line of electrolytic pots to which it belongs. It therefore extends lengthwise along the longitudinal direction Y, while the line of electrolytic pots extends lengthwise along the transverse direction X.

Each of the electrolytic pots 1 comprises a pot shell 3, which may be made of metal, for example steel, and an inner lining 5, typically made of refractory materials. Pot shell 3 is generally equipped with reinforcement cradles.

Each of the electrolytic pots 1 comprises at least one cathode assembly placed at the bottom of the pot shell 3, each cathode assembly comprising at least one cathode 7 which may be formed of several cathode blocks made of carbonaceous material and cathode conductors 9 to collect the electrolysis current and route it to cathode outputs 11 passing through the pot shell 3.

Each of the electrolytic pots 1 also comprises anode assemblies 12 comprising an anode support 13 and at least one anode block or anode 15 borne by the anode support 13. The anode support 13 comprises a support bar 17 which may extend substantially horizontally between two opposite longitudinal edges of the electrolytic pot and the stubs 19. The anode block 15 is attached to the anode support 13 by means of stubs 19 sealed with cast iron in holes provided for this purpose in the anode block 15. The anode block 15 may be made of carbonaceous material. The anode block 15 is often of the pre-baked kind. When in operation, the anode block 15 is immersed in an electrolytic bath 21 contained in each electrolytic pot 1 to be consumed there. The anode assemblies 12 are designed to be periodically removed and replaced when the anode blocks 15 have been largely consumed. Because of the consumption of the anode blocks 15, each of the electrolytic pots 1 comprises moving means 23 to translate the anode assemblies 12 vertically downwards. In this way, the anode blocks 15 are lowered as and when they are consumed, through an opening 16 bounded by the pot shell 3 and its inner lining 5.

The moving means 23 comprise, for each electrolytic pot 1, at least two anode receivers 25 designed to work in conjunction with the anode support 13, 17 to drive the anode assembly 12. The anode receivers 25 can be actuated by jacks 39. More specifically, each anode receiver 25 has a contact surface 27 working in conjunction with one surface of the anode contact 29 of the anode support 13, 17 to establish with said anode support a mechanical contact to drive the anode assembly 12 vertically. In this case, the contact surface 27 of the anode receivers 25 is arranged over said anode receivers, so that the anode assembly is borne on these anode receivers. It is therefore unnecessary to have means for securing the anode support 13, 17 onto the anode receivers 25. As explained in the following, the absence of fixing means compensates for the transverse and longitudinal expansions of the anode support 13, 17.

From an electrical point of view, the anode assemblies and the cathode assemblies of each electrolytic pot are electrically powered by a network of electrical conductors. The cathode outputs 11 of the electrolytic pots 1 are connected to routing conductors 31 to convey the electrolysis current collected by the cathode conductors 9 to the anode conductors electrically powering the anode blocks 15 of the next electrolytic pot. These routing conductors 31 generally extend in a substantially horizontal direction. The anode conductors are electrically connected between the routing conductors 31 and the anode assemblies 12. The anode conductors are designed to route the electrolysis current to the anode assemblies 12 and comprise flexible electrical conductors 33 to accommodate, by means of their flexibility, the vertical translation movement of the anode assemblies 12 and thereby make it possible to maintain the electrical connection during movement of the anode assemblies 12. The flexible electrical conductors 33 may be formed by superimposed flexible electrically conductive sheets. The cathode conductors 9, the cathode outputs 11 and the routing conductors 31 may be formed by metal rods, made for example of aluminum, copper or steel.

In one aspect of the invention, the contact surface 27 of each anode receiver 25 makes it possible to set up with the anode support 13, 17, not only a mechanical contact to vertically move the anode assembly 12, but also an electrical contact to route the electrolysis current between each anode receiver and said anode support.

To do this, each anode receiver 25 comprises a drive part 35 which is guided in vertical translation and an electrically conductive part. The drive part 35, which is often made of steel, is driven by the jacks 39 and guided in vertical translation by guiding means 51 which may be formed against the pot shell and the upper portion of the pot shell and, where appropriate, by a part of the pot superstructure. The conductive portion may be formed by rigid, non-deformable, electrical conductors, for example, formed by a metal rod, in particular made of steel, copper, aluminum or a steel/copper composite. The conductive part is part of the anode conductors described above, and therefore makes it possible to route the electrolysis current to an anode assembly 12. More specifically, the conductive part is electrically connected between the flexible electrical conductors 33, and the anode contact surface 29, of the anode support 13, 17. In FIG. 1, only the upper end of the conductive portion 37 has been shown, i.e. the part of the anode receiver 25 bearing the contact surface 27. The electrolysis current in the anode support 13, 17 is transported between the surface of the anode contact 29 of said support and the anode blocks 15 by means of electrical conductors 40, shown in black, incorporated into said anode support. The electrolysis current in the anode support 13, 17 is also transported by means of the stubs 19. As the contact surfaces 27 of the anode receivers 25 are arranged to support the anode assembly 12, the weight of the anode assembly strengthens the electrical contact between the anode receiver and the anode support. It follows that the conductivity of the electrolysis current is improved.

According to another aspect of the invention, the anode receivers 25 of the moving means 23 are placed outside a space defined by the top of the anode blocks 15 as they move through the opening 16. During the vertical movements of the anode assembly 12, either through the moving means 23 to compensate for the consumption of the anode block 15, or using handling tools during anode replacement operations, the anode receivers 25 are not in the path of the vertical translation of the anode blocks 15. Similarly, the anode conductors are also placed outside the space defined by the top of the anode blocks 15 as they move through the opening 16. The end of the anode conductors, which are in contact with the anode support 13, 17, is included in the conductive part 37 of the anode receivers 25, the latter being itself outside the space defined by the top of the anode blocks 15. It follows that anode replacement maneuvers are facilitated. This configuration also makes it possible not hinder the accessibility of tools working in the electrolytic pot. With the exception of a movable cover described below, no device is placed above the opening 16 which might hinder accessibility in each electrolytic pot 1.

According to another preferred aspect of the invention, compensating means working in conjunction, at least functionally, with the moving means are often necessary to absorb expansion of the anode support 13, 17.

In the embodiment shown in FIG. 1, the contact surface 27 of the anode receiver 25 is flat and horizontal, which means that it can absorb any expansion of the anode support 13, 17 by sliding of the anode contact surface 29 of this anode support on said anode receiver contact surface. It follows that, in this embodiment, the compensation means are substantially formed by the contact surface 27 of the anode receiver 25 and the anode contact surface 29 of the anode support 13, 17. This sliding of the anode contact surface 29 of the anode support 13, 17 on the contact surface 27 may be facilitated by the use of an electrically conductive grease applied on one of said surfaces.

Each of the electrolytic pots 1 includes a confinement chamber 41 for containment of the gases generated during the electrolysis reaction. This confinement chamber defines a closed volume above the opening 16 through which the anode assembly 12 is moved vertically. Note that the anode assemblies 12 are fully contained in the confinement chamber 41. The confinement chamber is formed, at least partially, by the pot shell 3 and a removable cover 43. The confinement chamber may include a superstructure receiving the removable cover 43 and placed above the pot shell 3. In the embodiment illustrated, the removable cover 43 rests on a fixed part 45 of a superstructure or an extension of the pot shell 3. The removable cover 43 means that anode assemblies 12 can be extracted and inserted from above, in each electrolytic pot 1, using handling tools. It also makes any work inside the electrolytic pot 1 easier.

The anode receivers 25 of the moving means 23 are partially inside the confinement chamber 41. An upper portion of the anode receivers 25 bearing the contact surface 27 is placed within the confinement chamber 41. A lower portion of the same anode receivers 25 attached to each jack 39 and electrically connected to the flexible conductors 33, is arranged outside the confinement chamber 41. The flexible electrical conductors 33 and jacks 39 are arranged outside the confinement chamber 41. The higher portion of the anode receivers 25 bearing the contact surfaces 27 extends within the confinement chamber 41 so that the electrical connection with the anode support 13, 17 is formed inside the confinement chamber 41. In this way, the anode assembly 12 is free of any interaction with the pot shell 3, the removable cover 43, and, where appropriate, the superstructure forming the confinement chamber 41. In this way, the confinement chamber 41 is not likely to be affected, either by replacement of the anode assembly or by moving the anode assembly downwards as the anode blocks 15 are consumed.

Dynamic seals are placed around the anode receivers 25 at the point where the anode receiver 25 passes through the confinement chamber 41 to prevent any gas generated during the electrolysis from leaving the confinement chamber 41. To improve the leak tightness of the confinement chamber 41, more particularly at the junction between the removable cover 43 and the fixed part 45, provision may be made for each electrolytic pot 1 to include seals 47 interposed between the removable cover 43 and the fixed portion 45 on which said removable cover 43 rests.

Figure 2:
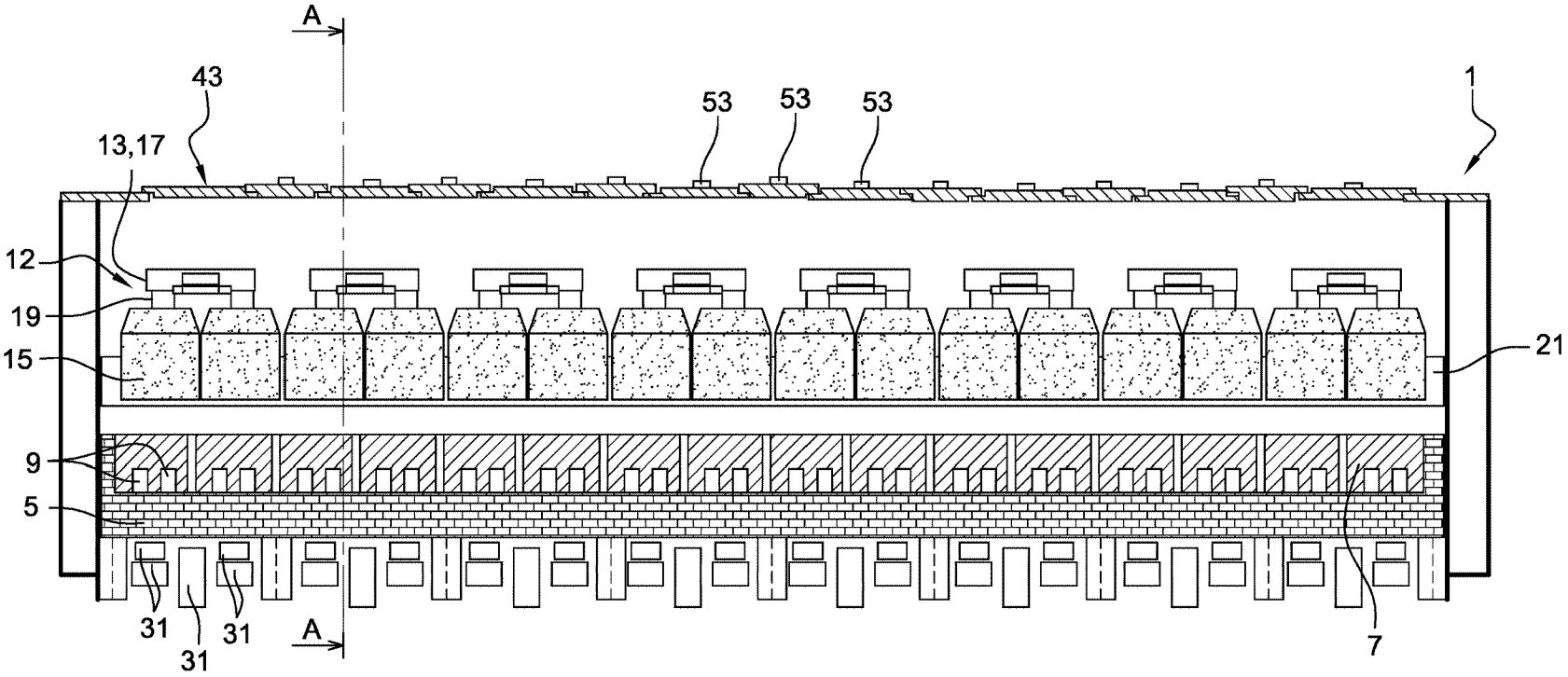
Figure 3:
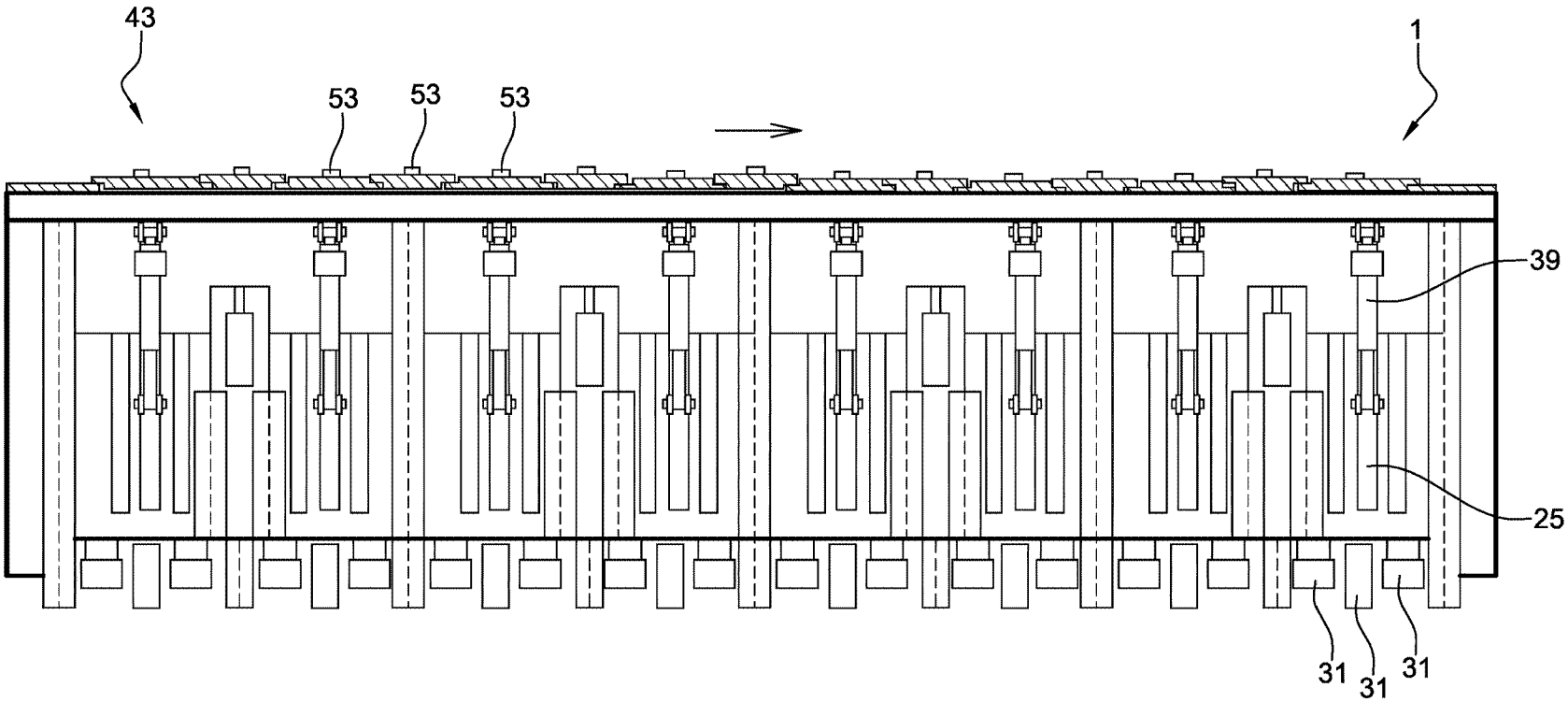
FIG. 3 shows a side view of the electrolytic cell of FIG. 1, along a plane defined by a longitudinal section C-C.

FIGS. 2 and 3 show that the removable cover 43 may include a plurality of hoods 53 adjacent, substantially longitudinal and parallel to each other, extending in a direction substantially transverse to X, between two opposite longitudinal edges of each electrolytic pot 1. In the embodiment shown in FIGS. 4, 5, 6, 7 and 8, the compensation means are arranged in the anode receivers 125, 126 of the moving means 123 associated with each electrolytic pot 101, i.e. more precisely between the upper part of the anode receivers 125, 126 bearing the contact surfaces 127, 128 and the drive portion 135, 136 of these same anode receivers guided in vertical translation. The compensation means comprise connecting members 161 arranged in the anode receivers 125 placed to the left of each electrolytic pot and connecting members 171 of another type arranged in the anode receivers 126 placed to the right of each electrolytic pot 101. The connecting members 161 are of the connecting rod type, while the connecting members 171 are of the ball type. The connecting members 161, 171 of the compensation means are arranged between the upper part and the drive part 135, 136 of the anode receivers 125, 126.

Figure 4:
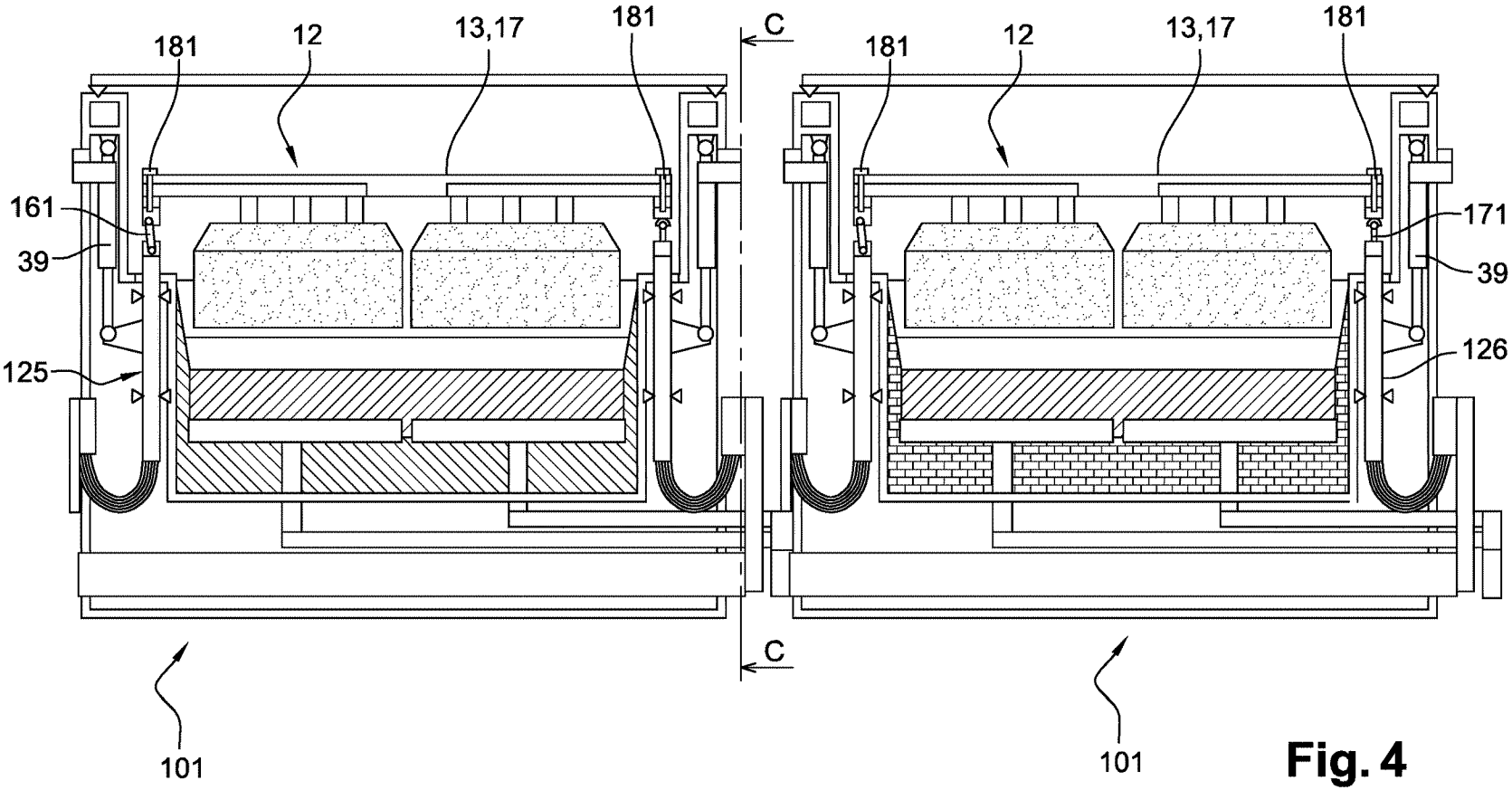
FIG. 4 shows a cross section of two adjacent electrolytic cells according to another embodiment of the invention.

Unlike the embodiment shown in FIG. 1, the anode support 13, 17 of anode assemblies 12 shown in FIG. 4 is attached to the anode receivers 125, 126 using fixing means comprising two complementary threads whose cooperation allows the anode support 13, 17 to be fixed simply by screwing using screws 181. The attachment means may comprise any type of connector, for example screws, providing a cladding and a compression of the anode support 13, 17 against the anode receivers 125, 126.

Figure 5:
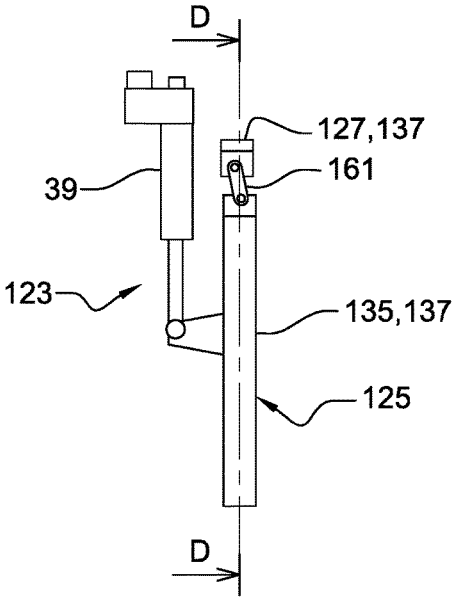
FIG. 5 shows a cross section, for one of the electrolytic cells of FIG. 4, of an anode receiver of the moving means comprising a connecting member of the connecting rod type and a jack working in conjunction with said anode receiver.
Figure 6:
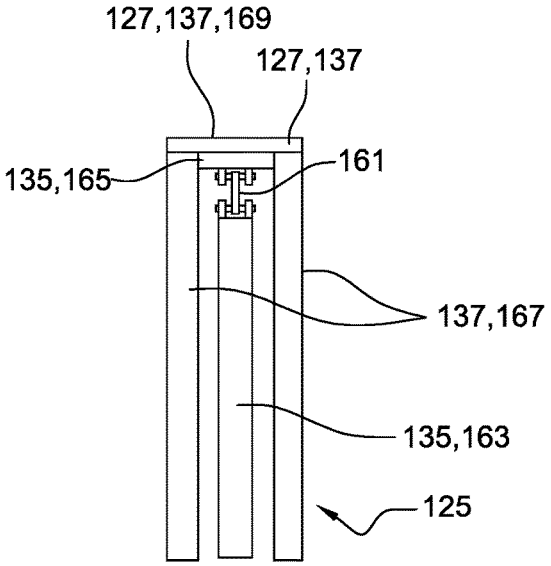
FIG. 6 shows a cross section of the anode receiver of FIG. 5, along a longitudinal section D-D.

With reference to FIGS. 5 and 6, showing in more detail the anode receivers 125 arranged to the left of each electrolytic pot 101, the drive section 135 includes a lifting mast 163 driven vertically by the jack 39. The drive portion also includes a steel sole 165 connected to the lifting mast 163 through the rod-type connecting member 161. The conductive portion 137 comprises two rigid lateral conductors 167 which are connected at their lower part to the flexible conductors 33 shown in FIG. 4. The conductive portion 137 further comprises a conductive copper sole 169 placed on the sole 165 and electrically connected to the two lateral conductors 167. The lateral conductors 167 are mechanically attached to the steel sole 165 and welded to the conductive sole 169.

Figure 7:
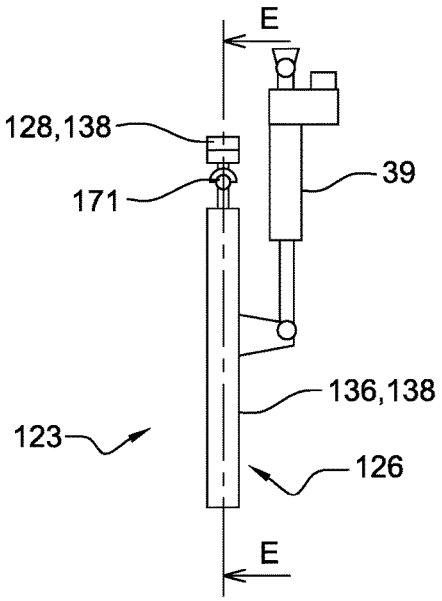
FIG. 7 shows a cross section, for one of the electrolytic cells of FIG. 4, of an anode receiver of the moving means comprising a connecting member of the ball type and a jack working in conjunction with said anode receiver.
Figure 8:
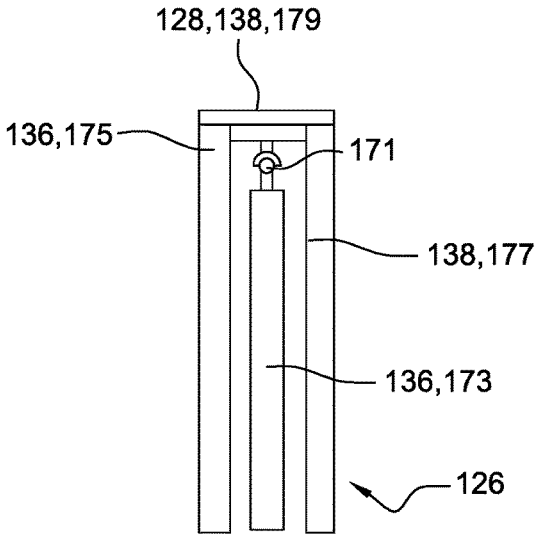
FIG. 8 shows a cross section of the anode receiver of FIG. 7, along a longitudinal section E-E.

With reference to FIGS. 7 and 8, showing in more detail the anode receivers 126 arranged to the right of each electrolytic pot 101, the configuration of the anode receivers 126 is similar to the anode receivers 125, except that the connecting member 171 is of the ball type. The drive portion 136 comprises a lifting mast 173 driven vertically by the jack 39. The drive portion also includes a steel sole 175 connected to the lifting mast 173 through the ball type connecting member 171. The conductive portion 138 comprises two rigid lateral conductors 177 which are connected at their lower part to the flexible conductors 33 shown in FIG. 4. The conductive portion 138 further comprises a conductive copper plate 179 placed on the sole 175 and electrically connected to the two lateral conductors 177. The lateral conductors 177 are mechanically attached to the steel sole 175 and welded to the conductive sole 179.

The rod-type 161 and ball-joint type 171 connecting members are able to absorb any expansion of the anode supports 13, 17. The rod-type connecting member 161 is mounted with its axes of rotation oriented in the longitudinal direction Y, which makes it possible to absorb any expansion of the anode support 13, 17 along the transverse direction. If the axes of rotation of the rod-type connecting members had been oriented in the transverse direction X, the compensation would be applied to absorb any expansion of the anode support along the longitudinal direction. The ball-type connecting member 171 makes it possible to, absorb any expansion of the anode support 13, 17 along the transverse direction and the longitudinal direction.

According to an embodiment not shown, the moving means are equipped with at least two anode receivers per anode assembly arranged on either side of the pot shell with respect to the transverse direction, a first rod-type connecting member being fitted to one of the anode receivers so as to absorb any expansion of said anode support along the transverse direction, and a second rod-type connecting member being fitted to the other anode receiver so as to absorb any expansion of said anode support along the longitudinal direction.

For each anode assembly, it is also possible to consider having at least one connecting member arranged on at least one anode receiver placed on a single side of the pot shell of the electrolytic pot.

In the embodiment shown in FIGS. 9, 10, 11 and 12, the compensation means are, as in the embodiment of FIG. 4, arranged in the anodic receivers of the moving means associated with each electrolytic pot 201.

Figure 9:
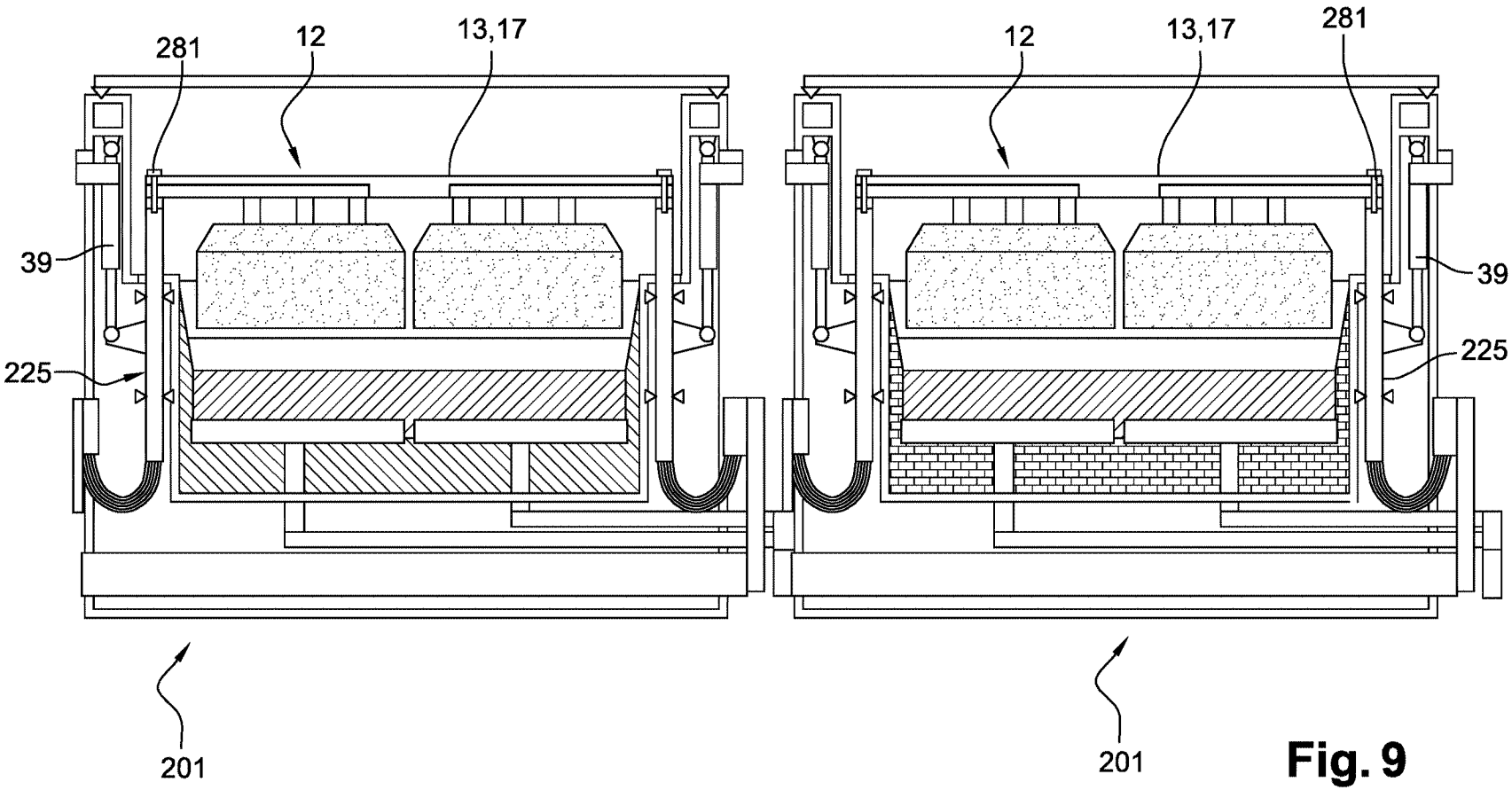
FIG. 9 shows a cross section of two adjacent electrolytic cells according to still another embodiment of the invention.

Unlike the embodiment shown in FIG. 1, the anode support 13, 17 of anode assemblies 12 shown in FIG. 9 is attached to the anode receivers 225 using fixing means comprising two complementary threads whose cooperation allows the anode support 13, 17 to be fixed simply by screwing using screws 281.

Figure 10:
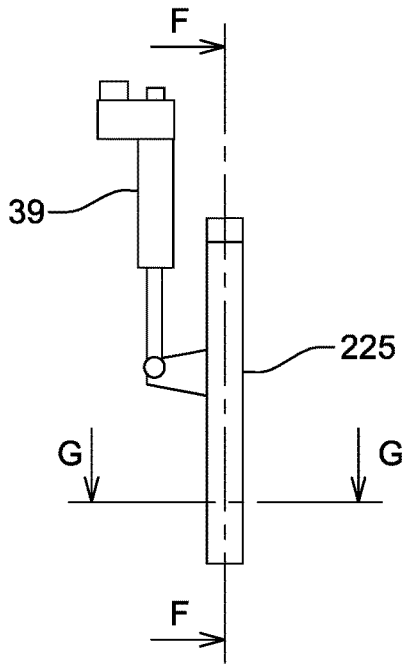
FIG. 10 shows a cross section of an anode receiver of the moving means of the anode assembly of one of the electrolytic cells of FIG. 9 and a jack working in conjunction with said anode receiver.
Figure 11:
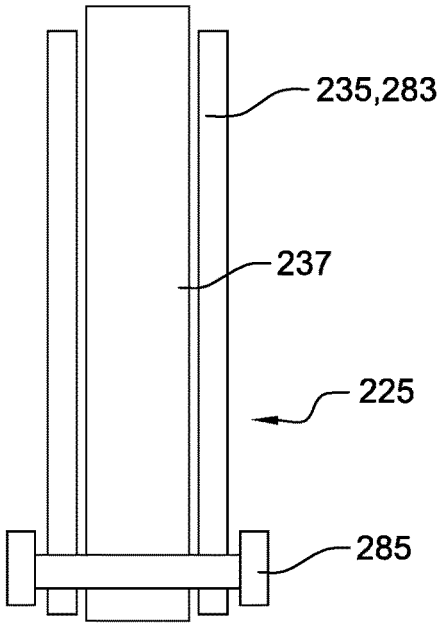
FIG. 11 shows a cross section of the anode receiver of FIG. 10, along a longitudinal section F-F.
Figure 12:
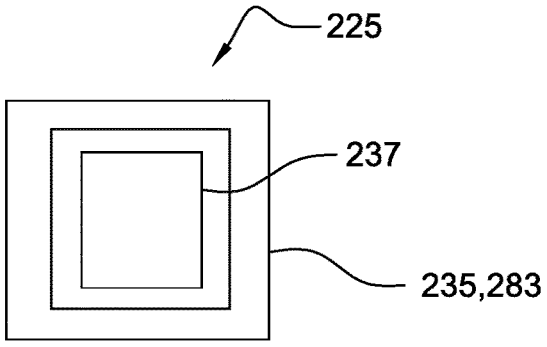
FIG. 12 shows a cross section of the anode receiver of FIG. 10, along a longitudinal section G-G.

Referring to FIGS. 10, 11 and 12 showing the anode receivers 225 in greater detail, the drive portion 235 of the anode receiver 225 comprises strapping 283 or a casing surrounding the conductive portion of the same anode receiver. The strapping 283 is made of rigid steel and constitutes the bulk of the drive portion 235 of the anode receiver 225. The strapping is driven in vertical translation by means of the jack 39. As shown in FIGS. 11 and 12, clearance is left between the conductive portion 237 and the strapping 283, so that said conductive part can move to take up the thermal expansion or any other unevenness of the anode support 13, 17. A sliding pivot 285 is arranged in the lower part of the receiver anode 225 to support the conductive part 237. The sliding pivot 285 could also be placed perpendicular to that shown in FIGS. 10 and 11, for example on the anode receiver 225 bearing the same anode assembly and placed on the other side of the pot shell.

The compensating means can also be arranged in the anode bearing the anode assembly. Anode assemblies 301, 401 incorporating such anode supports have been shown by way of example, in FIGS. 13 to 18.

Figure 13:
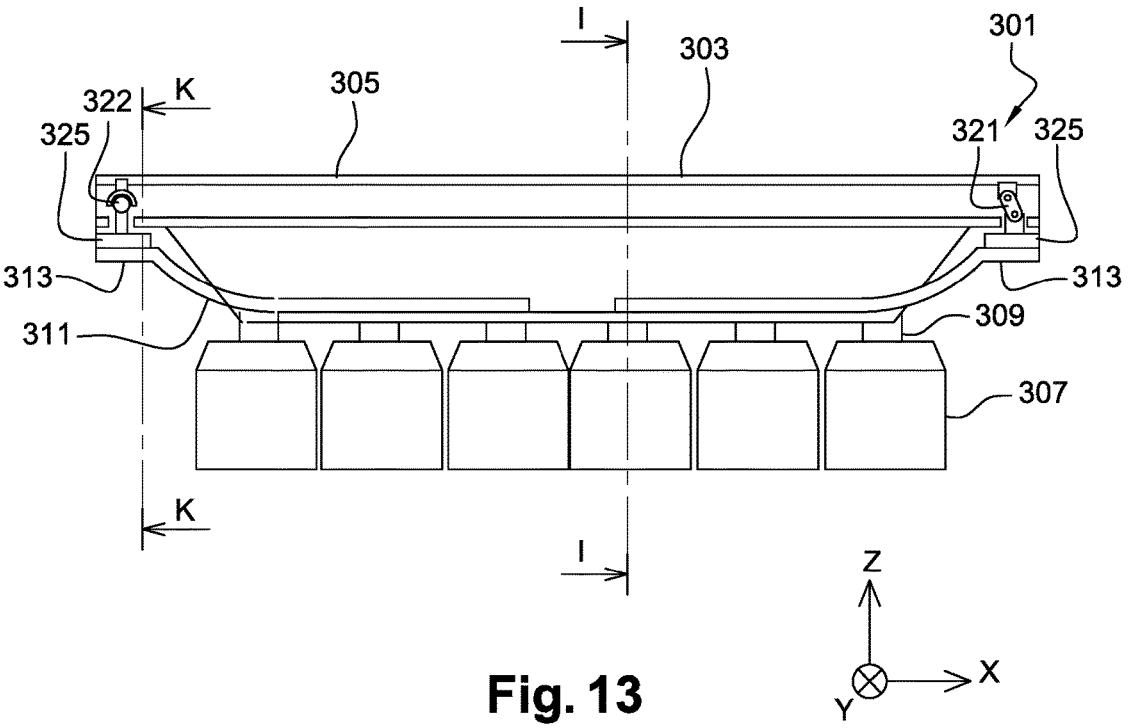
FIG. 13 shows a cross section of an anode assembly according to one embodiment of the invention.
Figure 16:
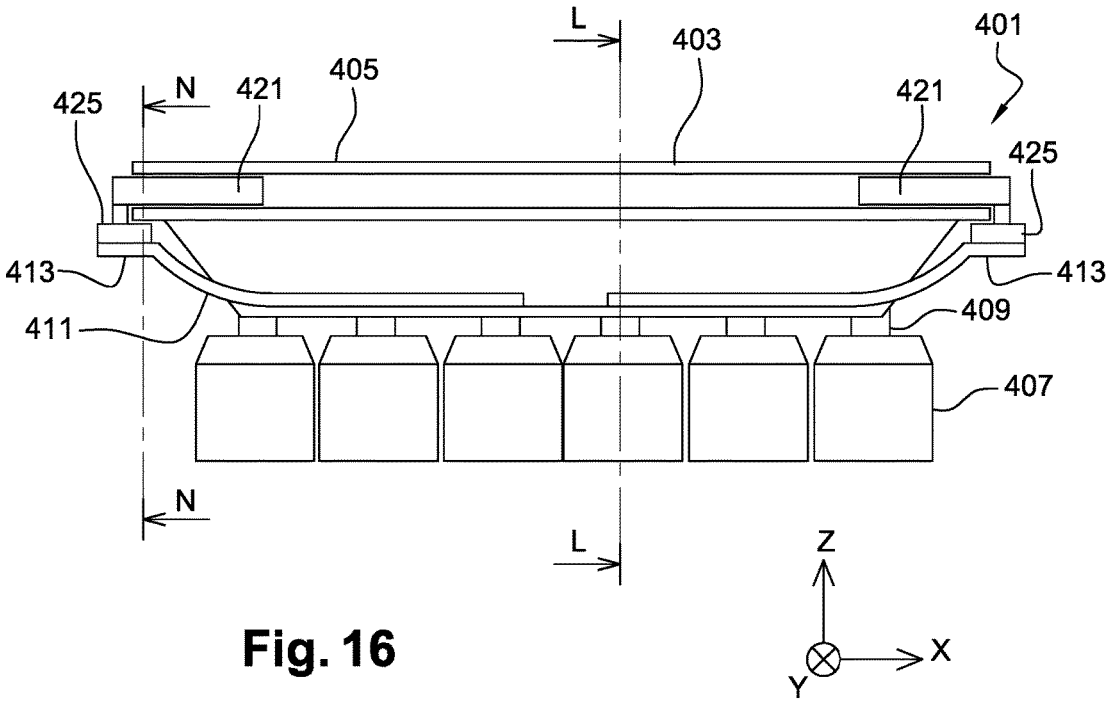
FIG. 16 shows a cross section of an anode assembly according to another embodiment of the invention.

Referring to FIGS. 13 and 16, the anode support 303, 403 of the anode assemblies 301, 401 extends along a main direction corresponding to the transverse direction X when the anode assembly is installed in the electrolysis device. A Cartesian coordinate system has been shown in FIGS. 13 and 16, for information, to show the positioning of the anode assemblies in relation to the electrolytic pots. Expansion of anode supports 303, 403 is mainly along the main direction. Expansion occurs to a lesser extent along a secondary direction of the anode supports 303, 403 corresponding to the longitudinal direction Y when the anode assembly is installed in the electrolysis device.

Anode supports 303, 403 of anode assemblies 301, 401 include frames 305, 405 supporting several anode blocks 307, 407 via stubs 309, 409. The anode supports 303, 403 also include a conductive portion 311, 411 formed by flexible electrical conductors. Each anode support 303, 403 comprises two anode contact surfaces in the shape of soles 313, 413 designed to work in conjunction with the corresponding contact surfaces of the anode receivers to establish electrical contact and mechanical contact. The anode contact surfaces 313, 413 are placed outside a space defined by the top of the anode blocks 307, 407, which makes it possible to support the anode assemblies on anode receivers of an electrolysis device which are arranged outside the vertical translation path of the anode blocks. The anode contact surfaces 313, 413 are arranged in the conductive portions 311, 411 and consist essentially of copper soles of said conductive portions. In this way, electrical contact between the anode receivers and the anode supports is improved.

Figure 14:
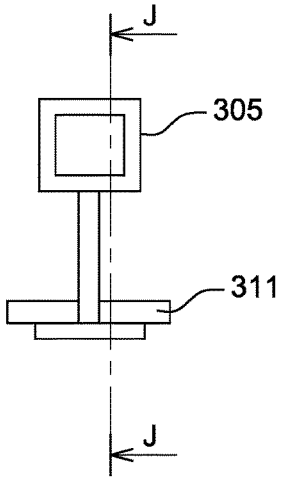
FIG. 14 shows a cross section of the anode support of FIG. 13, along a longitudinal section I-I.
Figure 17:
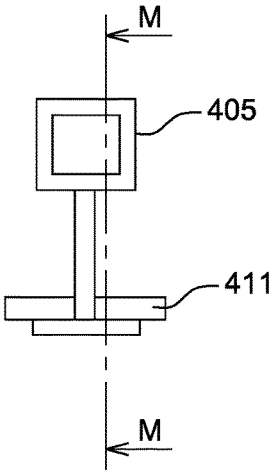
FIG. 17 shows a cross section of the anode support of FIG. 16, along a longitudinal section L-L.

As shown in FIGS. 14 and 17, frames 305, 405 comprise beams whose profile is shapes and designed to reduce bending of said beams under the weight of the anode blocks. The conductive portions 311, 411 may be formed from copper plates or strips which are not mechanically linked continuously with frames 305, 405 of the anode support. As shown in FIGS. 13 and 16, the conductive portions 311, 411 are more particularly connected to frames 305, 405 only at the anode contact surfaces 313, 413 and the stubs 309, 409. The conductive portions 311, 411 may bend slightly on the sections that are not connected to frames 305, 405 so as to absorb any thermal expansion of the anode support 303, 403.

Figure 15:
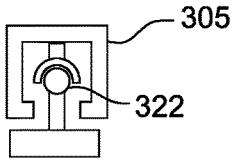
FIG. 15 shows a cross section of part of the anode support and compensating means of FIG. 13, along a longitudinal section K-K.

Referring to FIGS. 13, 14 and 15, the compensating means of the anode support 301 comprise a rod-type connecting member 321 placed between the anode contact surface 313 to the right of the anode assembly 301 and a main part of the frame 305. The compensating means of the anode support 303 comprise another connecting member of the ball-joint type 322 placed between the anode contact surface 313 to the left of the anode assembly and a main part of the frame 305. Specifically, the connecting members 321, 322 are arranged between the beam of the frame 305 and the steel soles 325 bearing the copper soles forming the anode contact surfaces 313.

The rod-type connecting member 321 is mounted with its rotational axes aligned along the secondary direction Y, which makes it possible to absorb any expansion of the anode support 303 along the main direction X. The rod-type connector may be called a longitudinal thermal expansion adjusting rod for the beam forming the anode support. If the axes of rotation of the rod-type connecting members had been oriented in the main direction X, the compensation would be applied to absorb any expansion of the anode support along the secondary direction. The ball-type connecting member 322 makes it possible to, absorb any expansion of the anode support along the transverse direction and the longitudinal direction. The ball-type connecting member may be called a torsion defect adjustment ball for the beam comprising the anode support.

Figure 18:
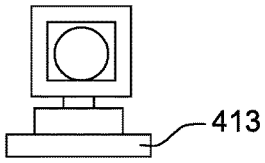
FIG. 18 shows a cross section of part of the anode support and compensating means of FIG. 16, along a longitudinal section N-N.

Referring to FIGS. 16, 17 and 18, the compensating means of the anode support 301 comprise two sliding type connecting members 421 or rail type, each of said connecting members being placed between one or the other anode contact surfaces 413 of the anode assembly and a main part of the frame 405. Specifically, the connecting members 421 are arranged between the beam of the frame 405 and the steel soles 425 bearing the copper soles forming the anode contact surfaces 413. The sliding type connecting members 421 are formed on one side by the beam of the frame 405 whose profile forms a rail, and on the other side by slides fitted to slide in the rail, each of said slides bearing the copper sole of each anode contact surface 413. The connecting member 421 helps to absorb any expansion of the anode support 403 along the main direction X. In addition, the sliding type connecting members 421 may also allow a slight rotation or pivot of the soles 425 around an axis parallel to the main direction X, of the substantially cylindrical portion of the slides. The connecting member 421 makes it possible to, absorb any expansion of the anode support 403 along the secondary direction Y.

According to an embodiment not shown, the compensating means of the anode assembly could comprise a single connecting member on one side or the other of the anode support. The connecting means may also comprise a ball-type member or pivot on one side of the anode support member and a sliding-type connecting member on either side of said anode support.

One advantage of the present invention is to facilitate access to, and handling of tools for working in the pot shell, in particular for anode replacement maneuvers, by providing a configuration in which the space above the opening defined by the inner lining of the pot shell is open.

Another advantage of the present invention is to facilitate assembly and disassembly of the anode assembly.

Yet another advantage of the present invention is to limit mechanical interactions with the anode conductors during anode replacement operations, which helps reduce wear and prevent damage.

Yet another advantage of the present invention is to allow anode replacement maneuvers to be performed without stopping the production of aluminum in the pot.

An advantage of a preferred embodiment of the present invention is to absorb any expansion of the anode support, particularly during anode replacement operations, without affecting operation of the moving means of the anode assembly.

The invention claimed is:

1. Electrolysis device for production of aluminum comprising a pot shell having an inner lining defining an opening through which at least one anode block is designed to be moved, the at least one anode block being suspended from an anode support forming with the at least one anode block an anode assembly movable relative to the pot shell, the device further comprising moving means comprising at least one anode receiver designed to work in conjunction with the anode support to move the anode assembly in a substantially vertical direction, the anode support being designed to be connected to anode conductors to route an electrolysis current to the at least one anode block, characterized in that the at least one anode receiver is placed outside a space defined by any vertical projection of a translation path of the at least one anode block during movement of the at least one anode block through the opening, the at least one anode receiver having a contact surface working in conjunction with a corresponding anode contact surface of the anode support to establish with the anode support an electrical contact to route the electrolysis current between the at least one anode receiver and the anode assembly and a mechanical contact to move the anode assembly in a substantially vertical direction.

2. Device according to claim 1, characterized in that the device is designed to receive a plurality of anode assemblies distributed along a longitudinal direction of the pot shell, the anode support of the anode assemblies extending along a transverse direction of the pot shell, the device further comprising compensating means working in conjunction with the moving means to absorb expansion of the anode support along the transverse and/or longitudinal direction.

3. Device according to claim 2, characterized in that the contact surface of the at least one anode receiver is arranged above the at least one anode receiver to bear the anode assembly.

4. Device according to claim 2, characterized in that the at least one anode receiver comprises a drive portion guided translationally in the substantially vertical direction and an electrically conductive portion.

5. Device according to claim 4, characterized in that the contact surface of the at least one anode receiver is arranged on the conductive portion of the at least one anode receiver.

6. Electrolysis device for production of aluminum comprising a pot shell having an inner lining defining an opening through which at least one anode block is designed to be moved, the at least one anode block being suspended from an anode support forming with the at least one anode block an anode assembly movable relative to the pot shell, the device further comprising moving means comprising at least one anode receiver designed to work in conjunction with the anode support to move the anode assembly in a substantially vertical direction, the anode support being designed to be connected to anode conductors to route an electrolysis current to the at least one anode block, characterized in that the at least one anode receiver is placed outside a space defined by any vertical projection of a translation path of the at least one anode block during movement of the at least one anode block through the opening, the at least one anode receiver having a contact surface working in conjunction with a corresponding anode contact surface of the anode support to establish with the anode support an electrical contact to route the electrolysis current between the at least one anode receiver and the anode assembly and a mechanical contact to move the anode assembly in a substantially vertical direction, characterized in that the device is designed to receive a plurality of anode assemblies distributed along a longitudinal direction of the pot shell, the anode support of the anode assemblies extending along a transverse direction of the pot shell, the device further comprising compensating means working in conjunction with the moving means to absorb expansion of the anode support along the transverse and/or longitudinal direction, characterized in that the at least one anode receiver comprises a drive portion guided translationally in the substantially vertical direction and an electrically conductive portion, characterized in that the contact surface of the at least one anode receiver is arranged on the conductive portion of the at least one anode receiver, and characterized in that the contact surface is substantially horizontal, the compensating means being essentially formed by the contact surface and the anode contact surface of the anode support working in conjunction with the contact surface, the expansion of the anode support in the transverse direction being absorbed by sliding of the anode contact surface on the contact surface in the transverse and/or longitudinal direction of the pot shell.

7. Device according to claim 6, characterized in that the sliding of the anode contact surface of the anode support on the contact surface is facilitated by the use of an electrically conductive grease applied on one of the anode contact surface and the contact surface.

8. Electrolysis device for production of aluminum comprising a pot shell having an inner lining defining an opening through which at least one anode block is designed to be moved, the at least one anode block being suspended from an anode support forming with the at least one anode block an anode assembly movable relative to the pot shell, the device further comprising moving means comprising at least one anode receiver designed to work in conjunction with the anode support to move the anode assembly in a substantially vertical direction, the anode support being designed to be connected to anode conductors to route an electrolysis current to the at least one anode block, characterized in that the at least one anode receiver is placed outside a space defined by any vertical projection of a translation path of the at least one anode block during movement of the at least one anode block through the opening, the at least one anode receiver having a contact surface working in conjunction with a corresponding anode contact surface of the anode support to establish with the anode support an electrical contact to route the electrolysis current between the at least one anode receiver and the anode assembly and a mechanical contact to move the anode assembly in a substantially vertical direction, characterized in that the device is designed to receive a plurality of anode assemblies distributed along a longitudinal direction of the pot shell, the anode support of the anode assemblies extending along a transverse direction of the pot shell, the device further comprising compensating means working in conjunction with the moving means to absorb expansion of the anode support along the transverse and/or longitudinal direction, characterized in that the at least one anode receiver comprises a drive portion guided translationally in the substantially vertical direction and an electrically conductive portion, characterized in that the contact surface of the at least one anode receiver is arranged on the conductive portion of the at least one anode receiver, and characterized in that the compensating means are arranged in the at least one anode receiver.

9. Device according to claim 8, characterized in that the compensating means are arranged between an upper portion of the at least one anode receiver bearing the contact surface and the drive portion.

10. Device according to claim 9, characterized in that the compensating means comprise at least one connecting member between the upper portion and the drive portion making it possible to absorb the expansion of the anode support along the transverse direction or the longitudinal direction.

11. Device according to claim 10, characterized in that the moving means are equipped with at least two anode receivers per anode assembly arranged on either side of the pot shell with respect to the transverse direction, a first connecting member of one of the anode receivers allowing any expansion of the anode support along the transverse direction to be absorbed, and a second connecting member of the other anode receiver to absorb any expansion of the anode support along the longitudinal direction.

12. Device according to claim 9, characterized in that the compensating means comprise at least one connecting member between the upper portion and the drive portion making it possible to absorb the expansion of the anode support along the transverse direction and the longitudinal direction.

13. Device according to claim 10, characterized in that the drive portion of the at least one anode receiver comprises a lifting mast driven translationally and a sole connected to the lifting mast via the connecting member, the conductive portion having at least one lateral conductor and a conductive plate arranged on the sole electrically connected to the at least one lateral conductor.

14. Device according to claim 8, characterized in that the drive portion includes strapping surrounding the conductive portion with sufficient clearance to allow the conductive portion to deform within the strapping and absorb the expansion of the anode support along the transverse and/or longitudinal direction.

15. Device according to claim 1, characterized in that the moving means are equipped with at least two anode receivers per anode assembly, the anode receivers being arranged along each longitudinal wall of the pot shell respectively, on an outside of the pot shell.

16. Device according to claim 15, characterized in that the at least two anode receivers per anode assembly are associated with separate drive means.

17. Electrolysis device for production of aluminum comprising a pot shell having an inner lining defining an opening through which at least one anode block is designed to be moved, the at least one anode block being suspended from an anode support forming with the at least one anode block an anode assembly movable relative to the pot shell, the device further comprising moving means comprising at least one anode receiver designed to work in conjunction with the anode support to move the anode assembly in a substantially vertical direction, the anode support being designed to be connected to anode conductors to route an electrolysis current to the at least one anode block, characterized in that the at least one anode receiver is placed outside a space defined by any vertical projection of a translation path of the at least one anode block during movement of the at least one anode block through the opening, the at least one anode receiver having a contact surface working in conjunction with a corresponding anode contact surface of the anode support to establish with the anode support an electrical contact to route the electrolysis current between the at least one anode receiver and the anode assembly and a mechanical contact to move the anode assembly in a substantially vertical direction, characterized in that the moving means are equipped with at least two anode receivers per anode assembly, the anode receivers being arranged along each longitudinal wall of the pot shell respectively, on an outside of the pot shell, and characterized in that the device includes guide means arranged along the longitudinal walls of the pot shell, on the outside of the pot shell, the guide means being arranged in a welded structure forming the pot shell.

18. Device according to claim 2, characterized in that the opening defined by the inner lining of the pot shell and the anode assembly is covered by a removable cover.

19. Electrolytic cell characterized in that the cell comprises an electrolysis device for production of aluminum comprising a pot shell having an inner lining defining an opening through which at least one anode block is designed to be moved, the at least one anode block being suspended from an anode support forming with the at least one anode block an anode assembly movable relative to the pot shell, the electrolysis device further comprising moving means comprising at least one anode receiver designed to work in conjunction with the anode support to move the anode assembly in a substantially vertical direction, the anode support being designed to be connected to anode conductors to route an electrolysis current to the at least one anode block, characterized in that the at least one anode receiver is placed outside a space defined by any vertical projection of a translation path of the at least one anode block during movement of the at least one anode block through the opening, the at least one anode receiver having a contact surface working in conjunction with a corresponding anode contact surface of the anode support to establish with the anode support an electrical contact to route the electrolysis current between the at least one anode receiver and the anode assembly and a mechanical contact to move the anode assembly in a substantially vertical direction, the electrolytic cell further comprising an electrolytic pot formed at least in part by the pot shell and the inner lining of the electrolysis device, and wherein the anode assembly comprising the at least one anode block is configured to be partially immersed in an electrolyte bath contained in the electrolytic pot.

20. Installation for electrolytic production of aluminum comprising a plurality of electrolysis devices for the production of aluminum, each electrolysis device comprising for the production of aluminum comprising a pot shell having an inner lining defining an opening through which at least one anode block is designed to be moved, the at least one anode block being suspended from an anode support forming with the at least one anode block an anode assembly movable relative to the pot shell, the device further comprising moving means comprising at least one anode receiver designed to work in conjunction with the anode support to move the anode assembly in a substantially vertical direction, the anode support being designed to be connected to anode conductors to route an electrolysis current to the at least one anode block, characterized in that the at least one anode receiver is placed outside a space defined by any vertical projection of a translation path of the at least one anode block during movement of the at least one anode block through the opening, the at least one anode receiver having a contact surface working in conjunction with a corresponding anode contact surface of the anode support to establish with the anode support an electrical contact to route the electrolysis current between the at least one anode receiver and the anode assembly and a mechanical contact to move the anode assembly in a substantially vertical direction.

21. Device according to claim 10, characterized in that the at least one connecting member comprises a connecting rod.

* * * * *